US006371131B1

(12) United States Patent
Finocchiaro et al.

(10) Patent No.: US 6,371,131 B1
(45) Date of Patent: Apr. 16, 2002

(54) COSMETIC SET

(75) Inventors: Sylvie A. Finocchiaro, New York, NY (US); Jacques A. Gerbron, Menton (FR)

(73) Assignee: Coty Inc., New York, NY (US)

( * ) Notice: Subject to any disclaimer, the term of this patent is extended or adjusted under 35 U.S.C. 154(b) by 0 days.

(21) Appl. No.: 09/404,943

(22) Filed: Sep. 23, 1999

Related U.S. Application Data

(60) Provisional application No. 60/101,846, filed on Sep. 25, 1998.

(51) Int. Cl.[7] ..... A45D 33/28

(52) U.S. Cl. ..... 132/297; 132/303; 132/294

(58) Field of Search ..... 132/294, 297, 132/303, 314, 73, 73.5, 318; 206/385, 486, 487, 488, 509, 562; 248/346.03, 346.04, 346.11

(56) References Cited

U.S. PATENT DOCUMENTS

| | | | | | |
|---|---|---|---|---|---|
| 1,370,294 | A | * | 3/1921 | Dumons | 206/486 |
| 1,570,326 | A | * | 1/1926 | Bangs | 132/294 |
| 1,701,860 | A | * | 2/1929 | Mullen | 132/294 |
| 1,933,538 | A | * | 11/1933 | Brazelton | 206/509 |
| 1,950,203 | A | * | 3/1934 | Wilson | 206/562 |
| 1,962,556 | A | * | 6/1934 | Eberhardt, Jr. | 206/562 |
| D154,625 | S | * | 7/1949 | Nussbaum | 132/73 |
| 2,461,968 | A | * | 7/1949 | Derham | 248/346.04 |
| 2,659,920 | A | * | 11/1953 | Bogan et al. | 132/73 |
| 2,672,980 | A | * | 3/1954 | Halbach | 206/486 |
| 2,714,471 | A | * | 8/1955 | Sherman | 206/509 |
| 2,727,645 | A | * | 12/1955 | Dore | 248/346.11 |
| 2,748,952 | A | | 6/1956 | Fleit et al. | 211/74 |
| 2,760,500 | A | | 8/1956 | Johnson, Jr. | |
| 3,885,578 | A | * | 5/1975 | Hicks | 132/73 |
| 4,135,645 | A | | 1/1979 | Kimmell | 222/83 |
| 4,533,051 | A | | 8/1985 | Fleming | 206/563 |
| 4,925,338 | A | | 5/1990 | Kapusta | 404/41 |
| 4,956,404 | A | | 9/1990 | Pelzig | 524/48 |
| 5,199,451 | A | * | 4/1993 | Montoli | 132/314 |
| 5,323,924 | A | | 6/1994 | Wolff | 220/410 |
| 5,379,901 | A | * | 1/1995 | Blachut | 132/294 |
| 5,383,554 | A | | 1/1995 | Cowan | 206/310 |
| 5,423,440 | A | | 6/1995 | Castaneda et al. | 215/49 |
| 5,562,642 | A | | 10/1996 | Smith et al. | 604/289 |
| D381,775 | S | | 7/1997 | Arntsen | D28/88 |
| 5,709,232 | A | | 1/1998 | Sheffler et al. | 132/295 |
| 5,755,418 | A | | 5/1998 | Kracke et al. | 248/311.3 |
| 5,931,169 | A | * | 8/1999 | Kervoalen | 132/294 |
| 6,123,198 | A | * | 9/2000 | Pflueger | 206/562 |

FOREIGN PATENT DOCUMENTS

| | | | |
|---|---|---|---|
| FR | 997502 A | 1/1952 | 20/4 |
| GB | 1369075 | 10/1974 | A47F/7/00 |

* cited by examiner

*Primary Examiner*—Todd E. Manahan
(74) *Attorney, Agent, or Firm*—Schwegman, Lundberg, Woessner & Kluth, P.A.

(57) ABSTRACT

The present invention comprises a holder for cosmetic devices. The holder comprises a main body with a wall that defines a hole for receipt of a cosmetic article. The annular or semi-annular wall also defines a roll or a groove for retaining the cosmetic article.

16 Claims, 11 Drawing Sheets

COSMETIC SET

This appln claims benefit of Prov. No. 60/101,846 filed Sep. 25, 1998.

FIELD OF THE INVENTION

The present invention relates to a device for storing cosmetics and to a method for storing cosmetics.

BACKGROUND OF THE INVENTION

Decorative cases and containers for articles such as jewelry and cosmetics have been found in archeological sites dating back to early antiquity. For instance, Egyptian priests who were experts in the making of perfumes and cosmetics would supply these products to high born men and women. These men and women would store the products in containers such as a casket. Ancient Greek vases are illustrated with images of young women using oils and unguents stored in bottles.

Some of the cases and containers have had such sculptural beauty and exquisite craftsmanship as to have value as works of art. Some of the cases and containers have had a utility as jewelry or decoration in their own right. For instance, small ampules of perfume were retained on chains and worn as necklaces. Hollow ring-shaped bracelets retained perfume within the hollow interior.

The Kimmell patent, U.S. Pat. No. 4,135,645, issuing Jan. 23, 1979, describes a self-defense ring member with an opening for a finger and a movable member coupled to the ring member. The movable member has secured thereto a container having a chemical substance such as mace that can be used for self-defense. The self-defense ring can be imparted with the appearance of a cosmetic container.

The Wolff patent, U.S. Pat. No. 5,323,924, issuing Jun. 28, 1994, describes a cosmetic container with a base and a cover attached to the base. The container encloses a tray with a basket. The container also includes a mirror.

SUMMARY OF THE INVENTION

One embodiment of the device of the present invention comprises a holder for cosmetic articles. The holder comprises a main body with a wall that defines a hole for receipt of a cosmetic article. The wall also defines a roll or a groove for retaining the cosmetic article.

One other embodiment of the present invention comprises a kit that comprises a holder for cosmetic articles and one or more cosmetic articles. The holder defines a wall that defines a roll. The cosmetic article includes an outer surface that defines a groove. The cosmetic article is retained in the holder when the roll is retained in the groove.

The present invention additionally includes a kit that comprises a holder for cosmetic articles and one or more cosmetic articles. The holder defines a wall that defines a groove. The cosmetic article includes an outer surface that defines a nub or roll. The cosmetic article is retained in the holder when the roll is retained in the groove.

The present invention also includes an ampule that may be positioned in the cosmetic holder. The ampule comprises a main body and a cap sealed to the main body at a neck portion. The neck portion comprises an upper support and a lower support.

DETAILED DESCRIPTION OF PREFERRED EMBODIMENTS

Figure 1:
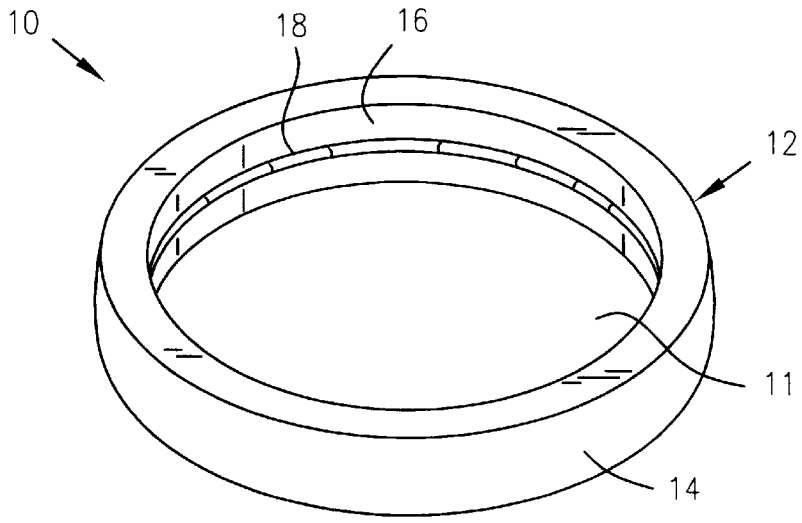
FIG. 1 is a perspective view of a single ring, single makeup article holder.

One embodiment of the cosmetic holder device of the present invention illustrated generally at 10 in FIG. 1 includes an annular main body 12 that has an outer surface 14 and an inner surface 16, the inner surface 16 defining an annular lip 18. The annular main body 12 and annular lip 18 are made of a material that has elasticity. While an annular main body is described herein, it is understood that other symmetries are useable in the holder device of the present invention. The other symmetries include squares, ovals, stars and other symmetric and asymmetric shapes.

Figure 2:
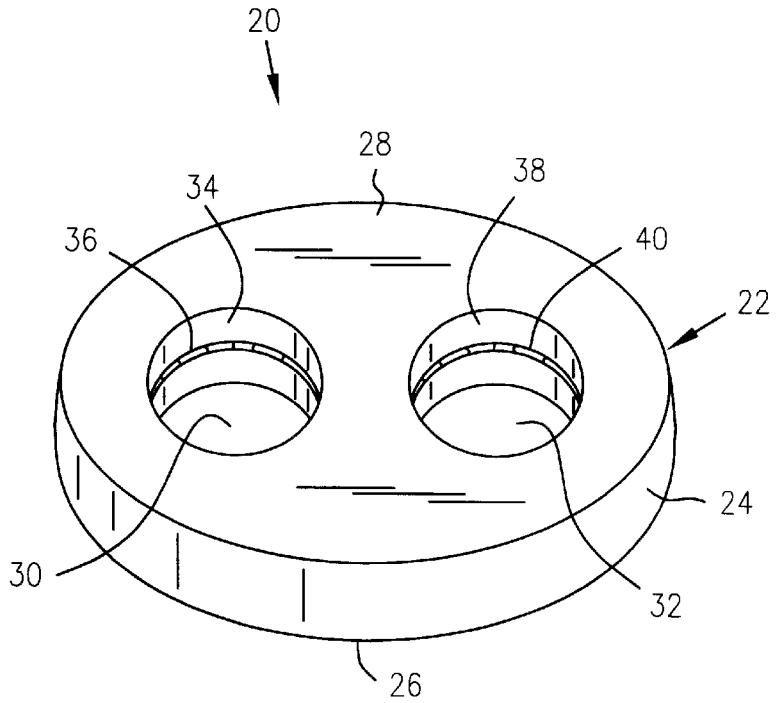
FIG. 2 is a perspective view of a single ring cosmetic holder capable of holding two cosmetic articles.

One other embodiment of the cosmetic ring holder of the present invention, illustrated generally at 20 in FIG. 2, includes a main body 22 defined by an annular side portion 24, an oval-shaped bottom portion 26 and an oval-shaped top portion 28. The top portion 28 defines a pair of holes 30 and 32. The ring holder 20 is also made of a material that has elasticity.

The cosmetic ring holder also includes an annular wall 34 defining hole 30 that includes a lip or roll 36. One other embodiment of the cosmetic holder includes an annular wall 38 defining hole 32 which also includes a lip or roll 40.

In another embodiment of the present invention is a method for storing a cosmetic article. With this method, a ring storage device such as is illustrated at 10, or a dual container storage device such as is illustrated at 20 is provided. A cosmetic article is sized to fit within a hole 11 defined by cosmetic holder 10 or holes 30 and 32 defined by cosmetic holder 20. The cosmetic article is inserted in the ring 10 by applying force to the cosmetic article in order to slightly expand the ring or compress the lip 18 so that the cosmetic article is secured by the lip 18 and by using the flexibility of the material of the ring. Cosmetic articles can be positioned within holes 32 and 30 in a similar manner. Cosmetic articles are then retained by lips 36 and 38, respectively.

"Cosmetic article" as used herein refers to a container of lipstick, eyeshadow, blush, foundation, toner, astringent, cleanser, mascara, concealer, lip balm, perfume or other fragrance in all forms including liquid solid or creme, deodorant, creme, powder, capsules containing skin care materials or fragrance and so on. The cosmetic article may have a disk shape or capsular shape or a bottle shape such as a fragrance spray bottle. The cosmetic article may include any article that contains fragrance or skin care or beauty enhancing material.

Figure 3:
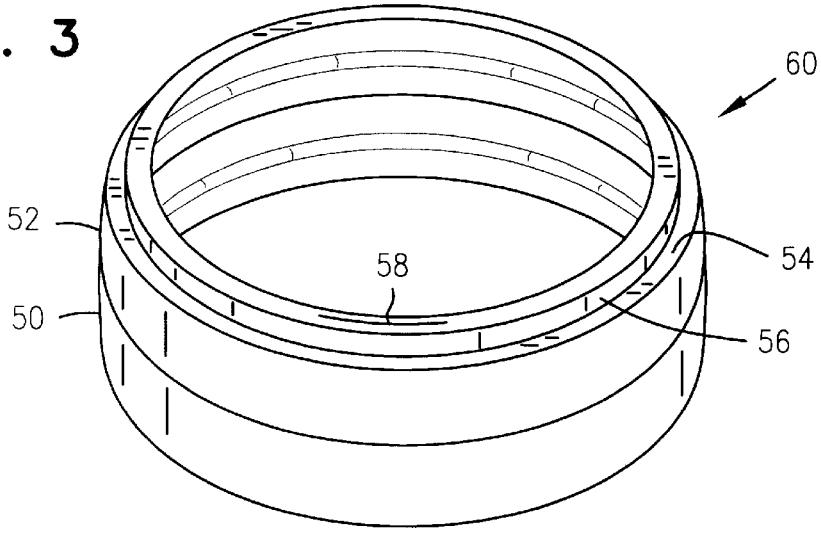
FIG. 3 is a perspective view of a stacked ring system, illustrated as two stacked rings holding two cosmetic articles.
Figure 3A:
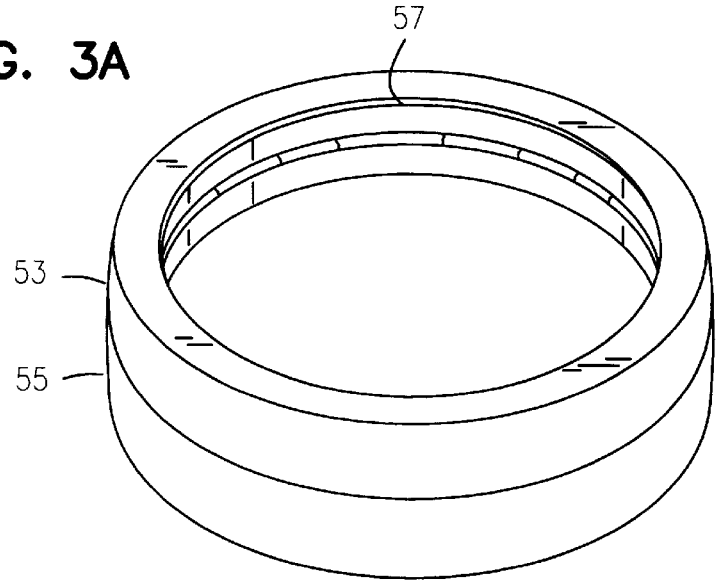
FIG. 3*a* is a perspective view of a stacked ring system, wherein the rings are attached to each other by threads.

In one other embodiment of the present invention, rings 50 and 52 are stacked and secured to each other by a securing mechanism, as illustrated at 60 in FIGS. 3 and 3*a*. In stacking the rings such as bottom ring 50 and top ring 52, the top ring 52 rests on an annular floor 54 and rests against a wall 56 perpendicular to the annular floor 54. The annular wall 56 defines a roll or lip 58 over which a ring such as 50 is positioned. The roll 58 retains the ring 50 to the ring 52. The wall 56 and roll or lip 58 are part of the ring 52. While two rings are shown in FIG. 3, it is contemplated that multiple rings may be stacked upon each other. The multiple rings may be stacked to form a makeup kit. The stack of rings can enclose containers for eye shadow, blush, powder and foundation, for instance.

A stack of rings may also be made by attaching rings such as ring 53 and ring 55 in FIG. 3*a*. The rings 53 and 55 include one or more threads, such as are shown at 57 for ring 53. The ring 55 includes one or more grooves for receipt of the threads.

Figure 4:
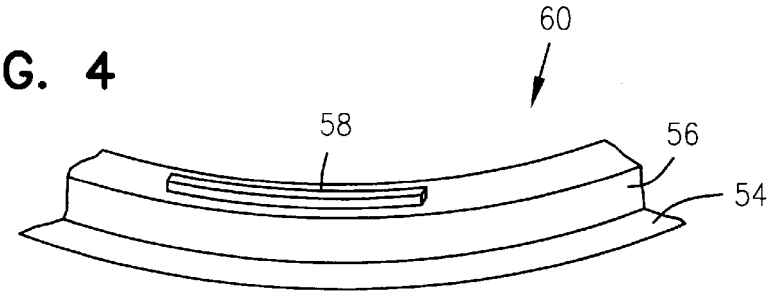
FIG. 4 is a perspective view of a locking mechanism for the ring system of FIG. 3.
Figure 14:
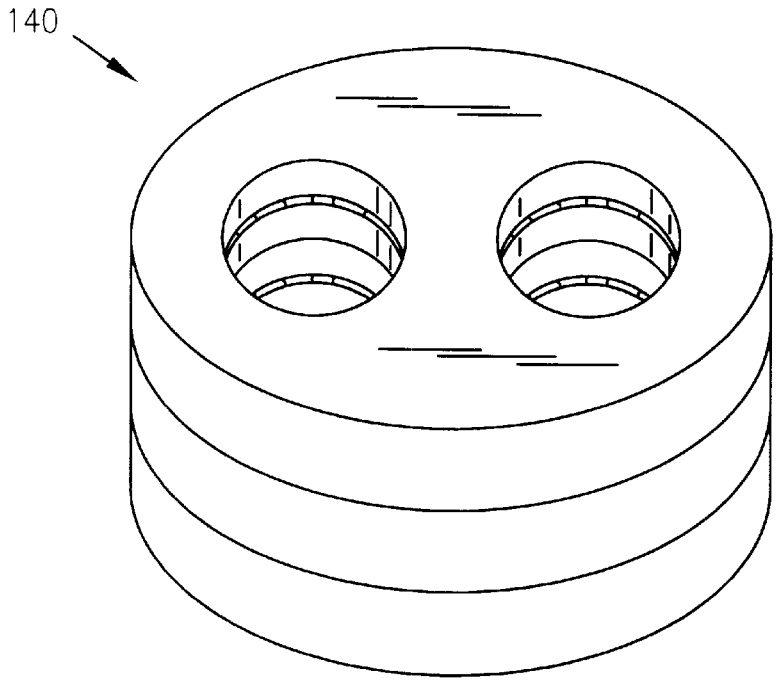
FIG. 14 is a perspective view of a stack of makeup holders, each holder capable of holding multiple makeup articles.

Cosmetic holders that hold two or more cosmetic articles such as are illustrated at 20 in FIG. 2 may also be stacked as is illustrated at 140 in FIG. 14. The stacking mechanism is the same as is described in FIG. 4.

Figure 8:
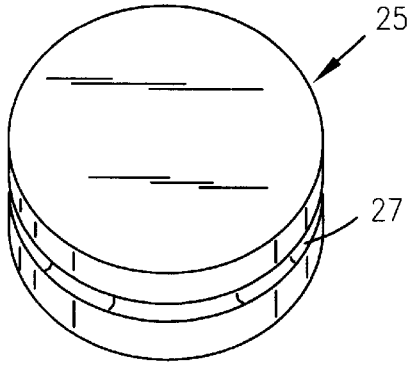
FIG. 8 is a perspective view of a makeup article with an annular groove.
Figure 9:
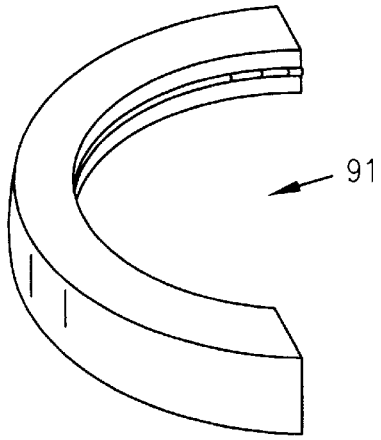
FIG. 9 is a perspective view of another embodiment of the makeup holder of the present invention.

The cosmetic holder device 10 and cosmetic holder system 60 are used to retain cosmetic articles that, in one embodiment define a groove, such as is illustrated for one cosmetic article 25 at 27 in FIG. 8. Makeup articles that are free of a groove may also be retained. While a circular symmetry is described for embodiments 10, 20, 50 and 52, other symmetries may be employed such as a square symmetry, oval symmetry, star symmetry and others. A partial symmetry, such as a semi-circle, as is illustrated at 90 in FIG. 9 may also be employed. The orifice in the cosmetic holder may be sized or shaped to receive virtually any cosmetic article.

The cosmetic holder device 10 and cosmetic holder system 60 of the present invention provide a unique form of display and storage for cosmetic articles. Because the cosmetic article may be "popped into" or "popped out of" any particular ring such as is illustrated at 10 or 20, due to the elasticity of the cosmetic holder, the cosmetic article may be displayed for different purposes.

Figure 5:
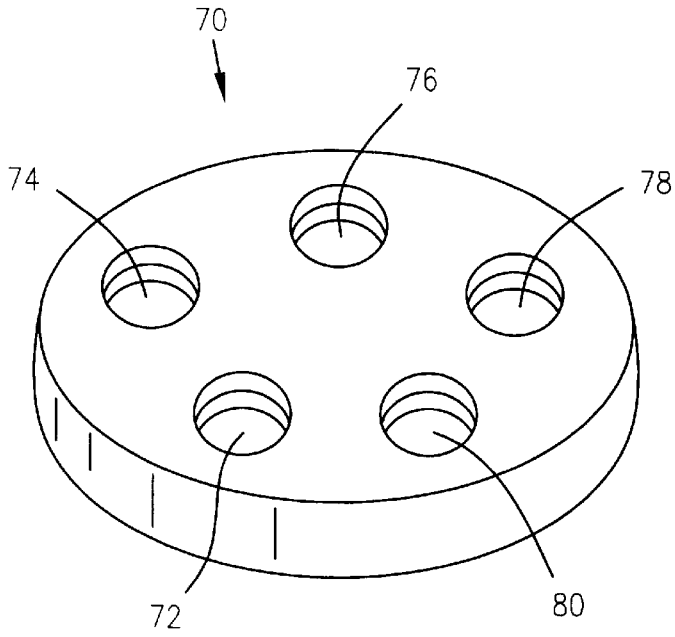
FIG. 5 is a perspective view of a single makeup holder that retains a plurality of cosmetic articles.
Figure 6:
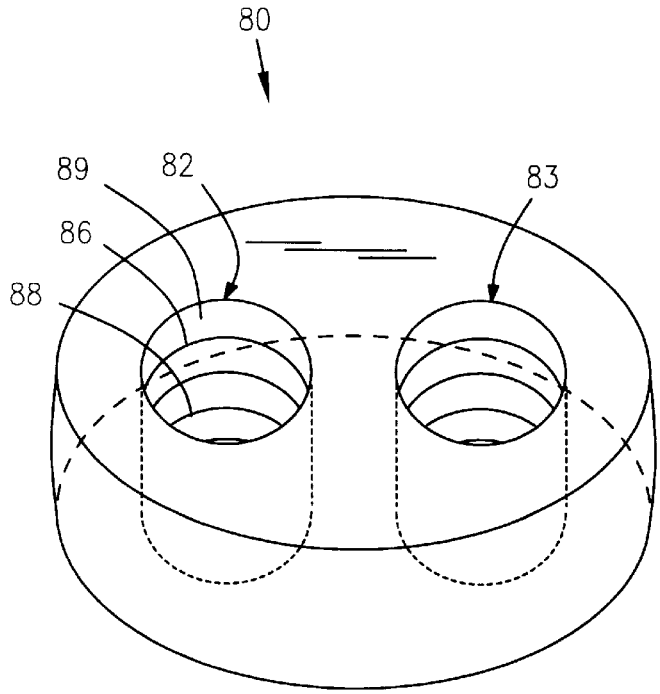
FIG. 6 is a side view of a single makeup holder that retains a plurality of cosmetic articles in a stacked positioning.

While the cosmetic holder 20 defines two holes 30 and 32, the cosmetic holder of the present invention may define a single hole or may define multiple holes. In one embodiment illustrated at 70 in FIG. 5, the holder defines holes 72, 74, 76, 78 and 80 for holding cosmetic articles such as eye shadow, blush, foundation, and powder. In one other embodiment, illustrated at 80 in FIG. 6, a holder 80 is of a height to stack cosmetic articles within one or more holes 82 and 83. The holder 80 includes an annular wall 84 that includes two lips 86 and 88 for retaining two cosmetic articles, one article on top of another.

Figure 7:
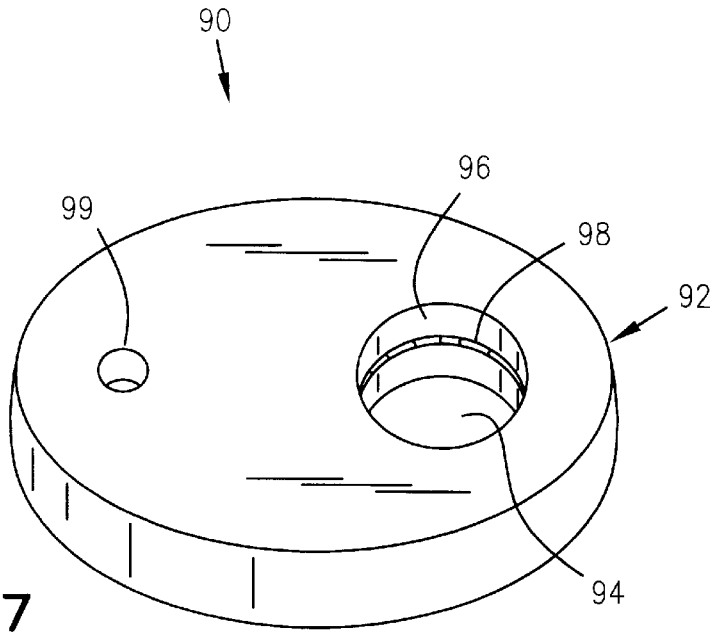
FIG. 7 is a perspective view of a single makeup holder that retains cosmetic tools.
Figure 18:
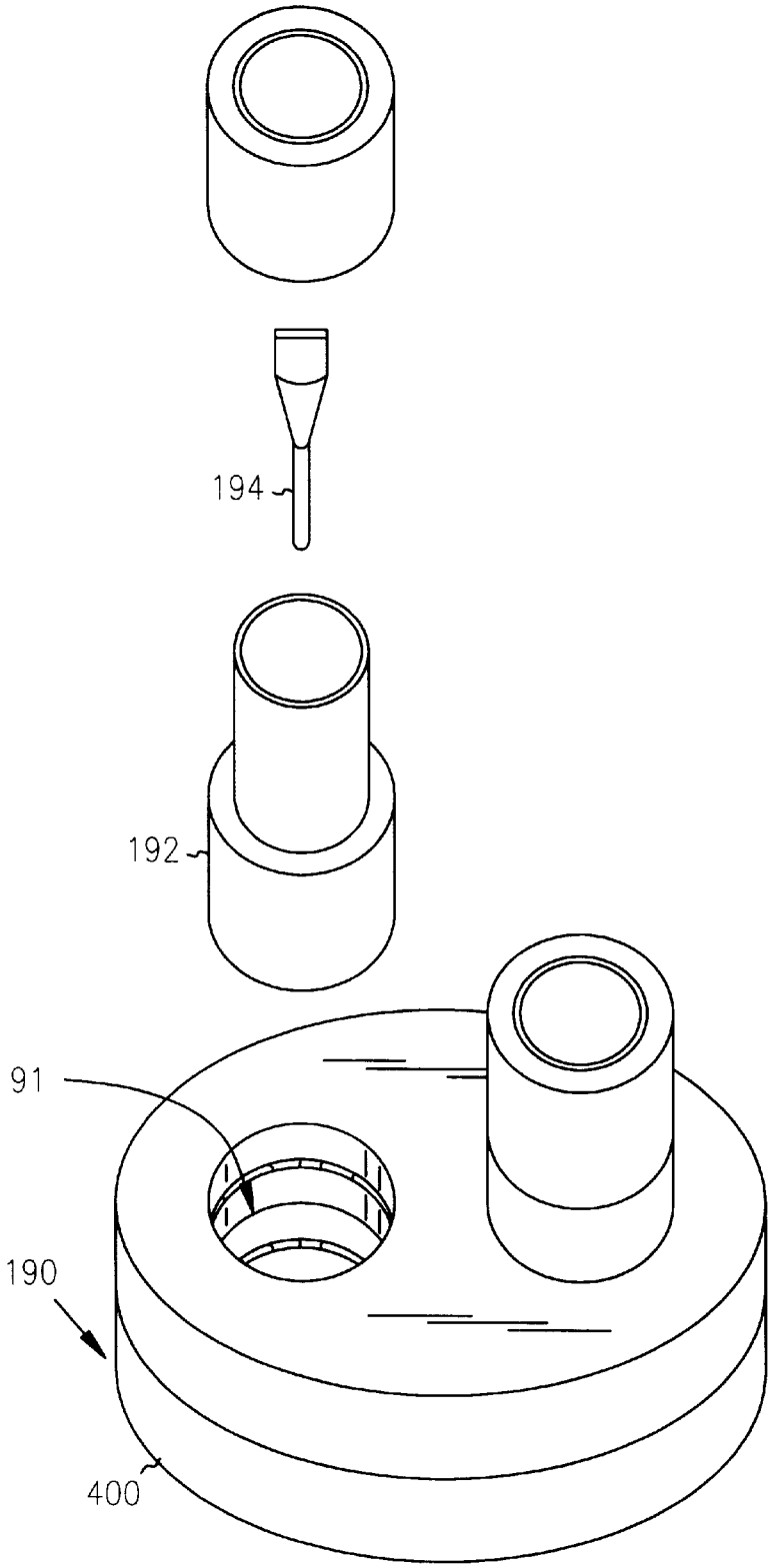
FIG. 18 is a perspective exploded view of a makeup holder of the present invention that retains a lipstick tube and a container for makeup tools.

One cosmetic holder of the present invention, illustrated at 90 in FIG. 7, includes a main body 92 that encloses a hole 94 for insertion of a cosmetic article. The hole 94 is defined by an annular wall 96 with an annular lip 98. The cosmetic holder and 190 in FIG. 18 90 also defines a second hole 91 for insertion of a container 192 of make up implements such as brushes 194 or other small cosmetic tools.

Figure 10:
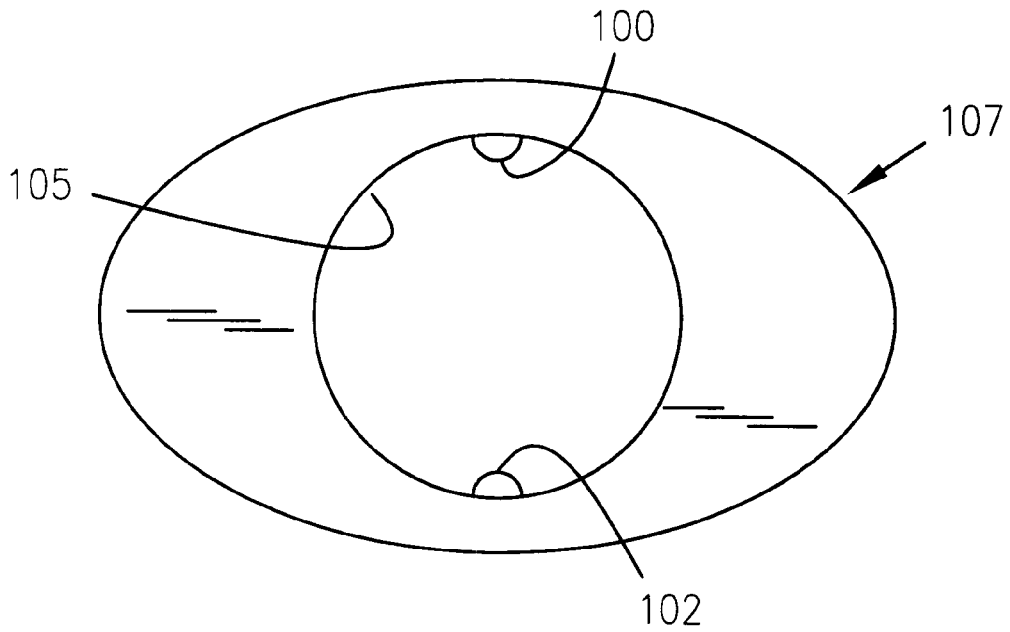
FIG. 10 is a top view of a makeup holder of the present invention that includes retaining nubs.
Figure 11:
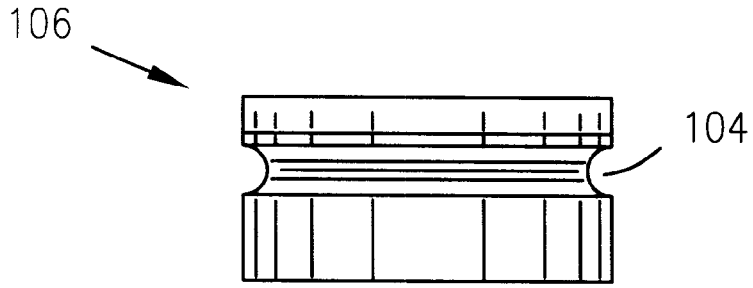
FIG. 11 is a side view of one embodiment of a makeup article of the present invention.

While an annular lip or roll, such as 98, is described, other retaining mechanisms may be employed. These other mechanisms include a pair of nubs, such as are illustrated at 100 and 102 in FIG. 10. The nubs are a segmentation of the continuous lip or roll. The nubs 100 and 102 are positioned on an inner annular surface 105 of the holder 107. The nubs 100 and 102 are engaged within a groove 104 of the makeup article 106 illustrated in FIG. 11. The makeup articles are retaining in the holder 107 by the roll or by the nubs through squeeze contact or by a lip groove contact for makeup articles with a groove.

Figure 15:
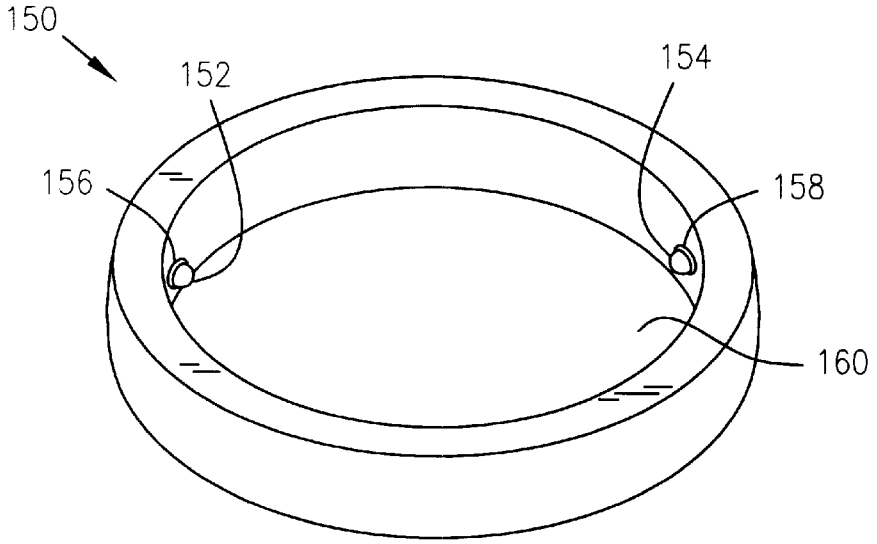
FIG. 15 is a perspective view of one embodiment of a makeup holders, each holder having retractable nubs for a cosmetic article.

In one other embodiment, illustrated at 150 in FIG. 15, the makeup articles are retained by a pair of retractable nubs 152 and 154. The retractable nubs 152 and 152 are positioned within bores 156 and 158. The nubs 152 and 154 are attached to springs of a tension that pushes the nubs into a space 160.

Figure 12:
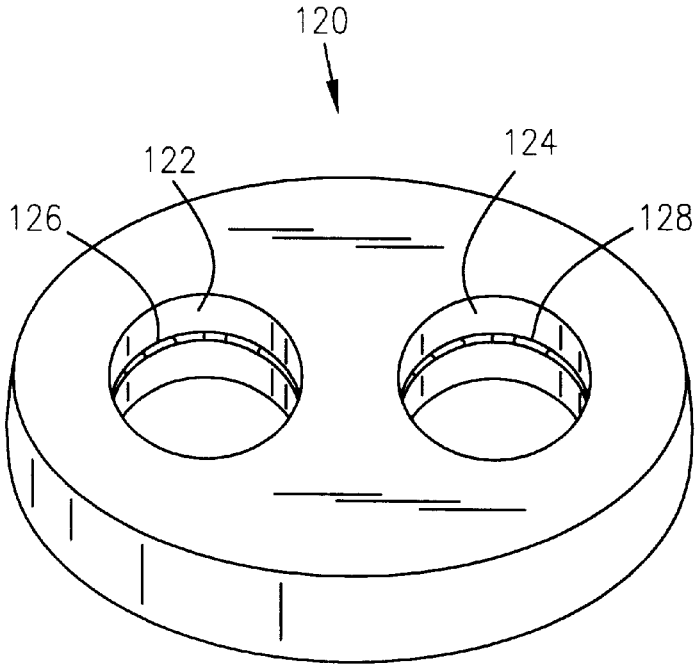
FIG. 12 is a perspective view of one embodiment of the makeup holder of the present invention that includes a groove.
Figure 13:
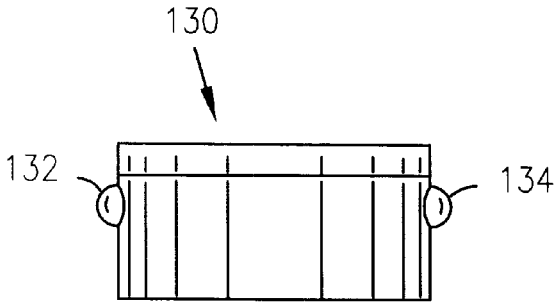
FIG. 13 is a side view of one embodiment of a makeup article that includes a pair of nubs.

The makeup holder of the present invention may, in one embodiment illustrated at 120 in FIG. 12, include annular walls 122 and 124 that define grooves 126 and 128. A makeup article such as is illustrated at 130 in FIG. 13 may be positioned within the makeup holder 120. The makeup article 130 is held in place by nubs 132 and 134 or an annular roll that are retained within either the groove 126 or 128. The roll may be continuous or segmented to form the nubs.

The makeup article may also be retained in the holder such as 53 in FIG. 3*a* or 50 in FIG. 3 by threads. In this embodiment, the makeup article includes grooves that can receive one or more threads.

The devices of the present invention may be made from a polymeric material such as polyolefin or polyethylene or PET or polypropylene or polyethylene or other polymer having an elasticity that permits it to "pop" over a nub. In one embodiment, the devices are made from a regular-branched, low-density, 0.92–0.93, polyethylene from Union Carbide Company under the name "Bakelite DYNK-1". In another embodiment, the materials are made of a high density, 0.95 or above, polyethylene available from Phillips Chemical Company under the name "Marlex 5012" or an isotactic-type polypropylene resin containing a minor amount of copolymerized ethylene having a density of 0.91 and a melt index of 0.55 at 230° C. A suitable polypropylene is marketed as TC-6-12 by the Shell Company. Other materials that may be employed to fabricate the products of the present invention include an amino resin, particularly melamine or a urea-formaldehyde resin. Other heat-setting resins may also be employed. Various catalysts or accelerators may be added to manufacture the resin in a known manner with the heat-setting resin employed. The holder may be made of a less elastic material if threads are used for attachment of the makeup article or for attaching one holder to another.

The material has properties of compressibility and elasticity. These properties permit the makeup article to be squeezed over the nub or roll. The material deforms in response to the force of movement of the makeup article. The deformation is reversible so that the material returns to its original shape when the cosmetic article is passed over the roll or nub.

Figure 19:
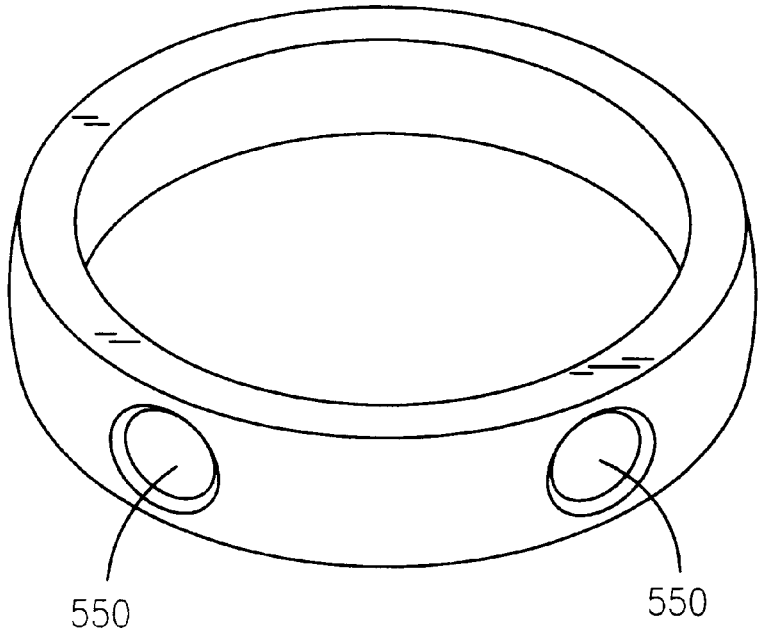
FIG. 19 is a perspective view of a single makeup holder of the present invention with a pattern.
Figure 20:
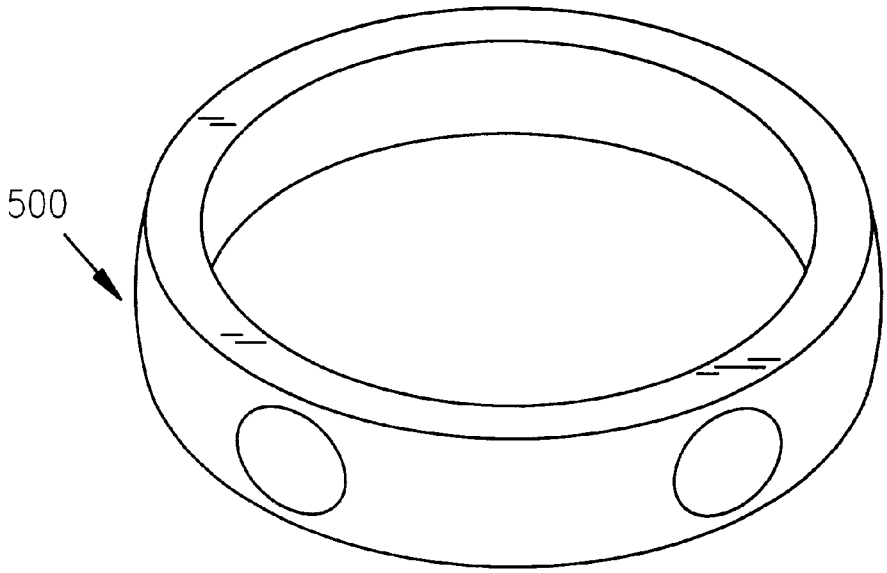
FIG. 20 is a perspective view of a single makeup holder of the present invention with embedded materials.

The makeup holders produced may be transparent, translucent or opaque. The holders may be colored or may be clear. The holders may be patterned with a pattern 550, as shown in FIG. 19 such as tortoise shell. The holders may be fabricated with materials embedded within the polymeric material such as illustrated at 500 in FIG 20.

The makeup holders may be hollow or solid. In one embodiment, illustrated at 190 in FIG 18 the makeup holder 400 is substantially solid with one or more hollow compartment regions 91 for storage of cosmetic tools such as small brushes 194.

Figure 21:
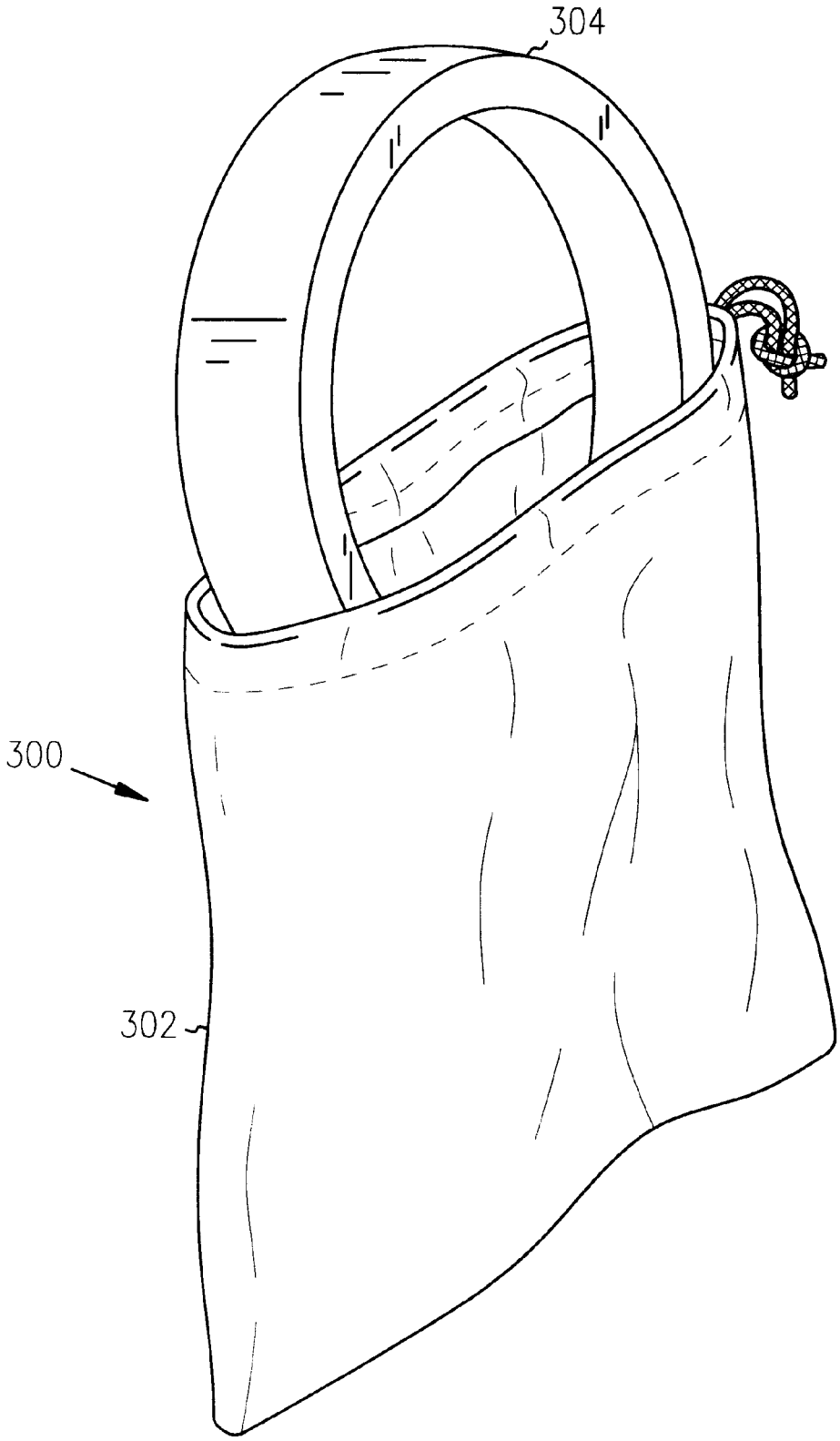
FIG. 21 is a perspective view of a make holder of the present invention packaged in a bag-type container.

The makeup holders 304 may be applied to cosmetic containers and packaged in containers 302 such as bags or sachets made of fabric or suede or a polymeric material as is illustrated at 300 in FIG. 21. The makeup holders may also be packaged in a box.

Figure 16:
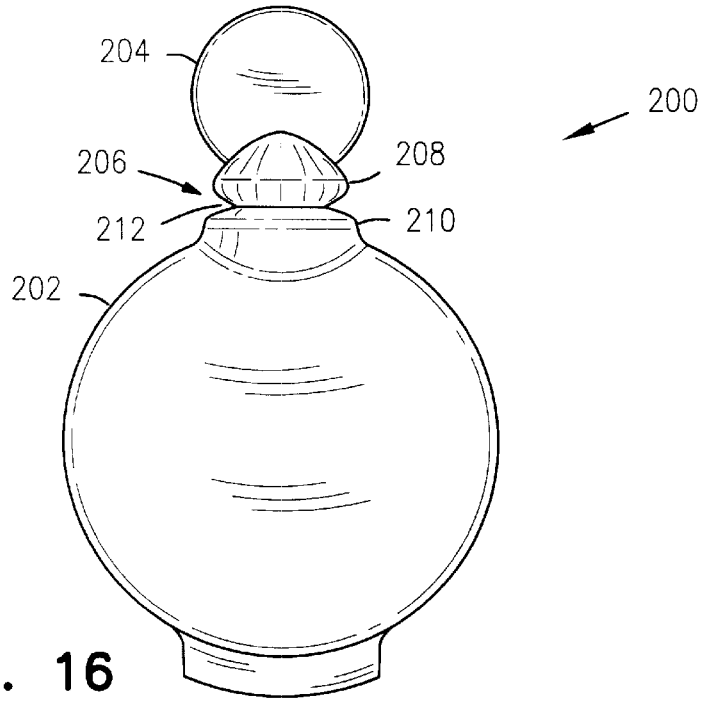
FIG. 16 is a front view of one embodiment of an ampule for containing a cosmetic.
Figure 17:
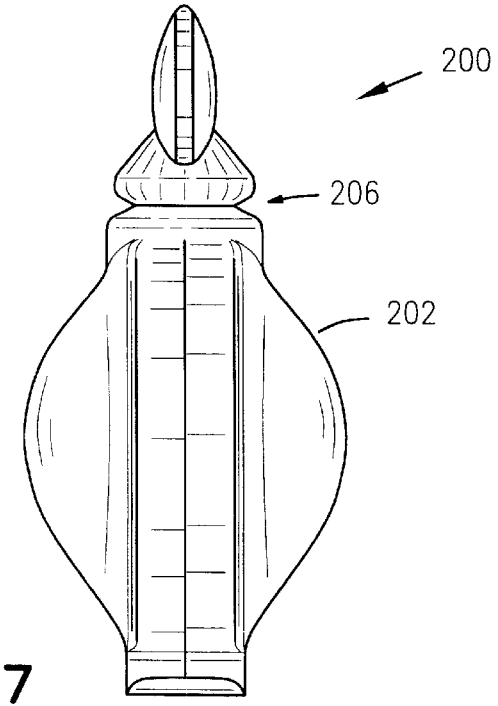
FIG. 17 is a side view of the ampule embodiment of FIG. 16.

One embodiment of an ampule for containing a cosmetic is illustrated at 200 In FIG. 16. The ampule 200 includes a flexible main body 202 and a cap 204 that is sealed to the main body 202 at a neck portion 206. The neck portion comprises an upper support 208 and a lower support 210 that meet to form a seam 212. The ampule may be inserted into the cosmetic holder of the present invention.

The ampule is made from a material such as polyethylene, polypropylene, and PET. The ampule is made utilizing a process such as extrusion blowing, or injection blowing. The cap 204 is sealed to the main body 202 after filling the main body with a cosmetic. It is contemplated that the ampule is used to enclose a fragrance. The fragrance may be in a solid, aqueous based or solvent based liquid or oil or creme form. The ampule is this instance is made of a material compatible with the fragrance form, such as a silica-based material or inert polymer.

If the main body is filled with cosmetic before cap formation, the cap 204 is constructed to form a flat, hard cap 204 that can be twisted open. Twisting breaks open the ampule at the seam 212.

The neck portion 206 has a diameter that is determined by the type of cosmetic enclosed. A large diameter is used for cosmetic of high viscosity.

The ampule may be sold with makeup or skin care product or fragrance as a separate item. The ampule may be used to contain samples of makeup or skin care product or fragrance or material used in aromatherapy.

In the foregoing description, the invention has been described with reference to specific embodiments thereof. It will, however, be evident that various modifications and changes may be made thereto without departing from the broader spirit or scope of the present invention as defined in the appended claims. The specification and drawings are, accordingly, to be regarded in an illustrative rather than a restrictive sense.

What is claimed is:

1. A cosmetic set, comprising:

at least two cosmetic containers; and a main body comprising at least one outer oval-shaped annulus defining an oval perpendicular to the annulus, the oval defining orifices in which the two cosmetic containers are arranged side by side, the orifices further defined by walls that extend from the oval, the walls comprising opposing projections and an edge web, wherein the cosmetic containers are positioned on the edge web and are at least partially retained by the projections, wherein the projections are made of a hard plastic material which permits a form fit of a cosmetic container in the oval shaped annulus and oval by slightly compressing the elastic material so that each container can be fitted into the oval or pushed out of the oval by finger pressure.

2. The cosmetic set according to claim 1, wherein the cosmetic container includes one or more pots of eyeshadow or a fragrance bottle or a capsule.

3. The cosmetic set according to claim 1, wherein the cosmetic container includes one or more pots of makeup.

4. The cosmetic set according to claim 1, wherein the cosmetic container includes one or more pots of cream.

5. The cosmetic set according to claim 1, wherein the cosmetic container is a lipstick container.

6. The cosmetic set of claim 1, wherein the cosmetic container contains a set of brushes or small tools or both.

7. The cosmetic set of claim 1 wherein the cosmetic container is transparent.

8. The cosmetic set of claim 1 wherein the cosmetic container fits into two rings that are in contact and are arranged one above the other.

9. The cosmetic set of claim 1 wherein the roll is inseparably attached to the outer ring.

10. The cosmetic set of claim 1 wherein the roll is segmented.

11. The cosmetic set of claim 1 wherein the roll is detachably fitted into the outer ring and projects out of the inside surface of the outer ring and thus partially projects into the inside space.

12. The cosmetic set according to claim 1 wherein the outer ring is transparent.

13. The cosmetic set of claim 1 wherein the outer ring is a transparent color.

14. The cosmetic set of claim 1 wherein the outer ring is patterned.

15. The cosmetic set of claim 1 wherein the outer ring has decorative elements which are visible at least from the outside of the ring and are either embedded in the ring material or project spatially out of it.

16. The cosmetic set of claim 1 wherein it is arranged in a solid or multi-colored fabric bag.

* * * * *